United States Patent [19]

Brightman

[11] 4,283,607

[45] Aug. 11, 1981

[54] CAM CONTROL MECHANISM

[75] Inventor: Ben W. Brightman, Scott Township, Vanderburgh County, Ind.

[73] Assignee: Whirlpool Corporation, Benton Harbor, Mich.

[21] Appl. No.: 68,971

[22] Filed: Aug. 23, 1979

[51] Int. Cl.[3] ..... H01H 43/10

[52] U.S. Cl. ..... 200/38 R; 74/567; 74/568 FS

[58] Field of Search ..... 200/38 R; 74/567, 568 R, 74/568 FS, 568 M, 568 T

[56] References Cited

U.S. PATENT DOCUMENTS

| | | | |
|---|---|---|---|
| 1,909,138 | 5/1933 | Vollmer | 74/567 X |
| 4,130,746 | 12/1978 | Linstromberg | 200/38 R |

*Primary Examiner*—J. V. Truhe
*Assistant Examiner*—Morris Ginsburg
*Attorney, Agent, or Firm*—Wegner, Stellman, McCord, Wiles & Wood

[57] ABSTRACT

A cam operated control mechanism wherein a cam follower is caused to move from a first position to a second position by a biasing spring upon completion of a preselected amount of relative movement between the cam follower and cooperating cam. The control mechanism includes a second structure for effecting movement of the cam follower from the first position to the second position in the event the biasing spring fails to effect the movement, such as by virtue of the spring being broken. The structure for effecting the transfer includes a displaceable wall portion of the cam against which the cam follower is urged by means other than the spring means when the relative movement between the cam follower and cam is continued following the failure of the spring means to effect the desired transfer. The control mechanism is advantageously adapted for use in ice makers and the like where it is highly desirable to prevent malfunctioning of the ice maker as a result of such a broken spring in controlling the switch mechanism thereof.

19 Claims, 4 Drawing Figures

CAM CONTROL MECHANISM

BACKGROUND OF THE INVENTION

1. Technical Field

This invention relates to control mechanisms and in particular to cam operated control mechanisms wherein a cam follower is caused to snap from one position to another as a result of relative movement between the cam follower and cooperating cam.

2. Background Art

In U.S. Pat. No. 4,130,746 of William J. Linstromberg, which patent is owned by the assignee hereof, a snap action cam for a timer switch is disclosed which is arranged to provide substantially positive throwing of the switch in both directions so as to avoid a dead break condition wherein the switch is maintained in intermediate position between the two operating conditions. The control mechanism is shown for use with an ice maker wherein the switch controls operation of different elements of the refrigeration apparatus and ice maker structure. The snap action cam effectively prevents hangup of the switch which condition had occurred in prior art devices causing undesirable discontinuation of the operation of the ice maker. The switch controls operation of the timer motor which further serves as a means for driving the switch cam itself. The control mechanism utilizes the gradual movement of the cam to effect the desired rapid throwing of the switch to either of its operational conditions.

The present invention is concerned with a control mechanism generally similar to that of the Linstromberg patent but wherein means are provided for assuring continued operation of the control mechanism in the event of a failure of the spring means to move the cam follower from the first position to the second position, such as may result from a breaking of the spring.

While the Linstromberg U.S. Pat. No. 4,130,746 would appear to comprise the closest background art, a number of additional patents are pertinent in this regard. More specifically, Dominick Feroleto in U.S. Pat. No. 3,004,449 shows a cam having a relatively movable portion by means of which the operating surface of the cam is modified during operational use. The invention is intended to provide a variation in the circumferential extent of the cam as a function of the pressure applied by the cam follower.

In U.S. Pat. No. 2,851,593, Stuart Machlin shows a television input tuner wherein a lip and cam cooperate to move the control shaft without utilization of springs or other resilient means. A portion of the cam is discontinuous so as to permit movement of the cam follower therethrough. A portion of the cam follower always remains in contact with the inner cam surface.

Wallace L. Linn et al. in U.S. Pat. No. 3,710,043 show a cam operated switch wherein a deflectable tongue portion is deflected by riding over a ramp to store energy therein, the stored energy being delivered to a switch upon further rotation of the cam beyond the ramp.

Knut J. Magnusson in U.S. Pat. No. 3,236,107 shows a timing mechanism having a plurality of parallel slide cams, one of which includes slots through which a cam follower moves to actuate a switch. Magnusson et al. also disclose a rotary cam having slots through which the cam follower moves.

DISCLOSURE OF INVENTION

The present invention comprehends an improved cam control mechanism having a novel fail-safe means for assuring a desired transfer of the cam follower from a first position to a second position.

The cam control mechanism utilizes a cam follower which is biased so as to snap from a first position to a second position to quickly and positively operate a control switch. Biasing is effected by a spring carried by the rotating cam. The invention comprehends providing a second means for effecting transfer of the cam follower from the first position to the second position in the event the spring fails to effect the transfer, such as where the spring has become broken, etc.

Specifically, the invention comprehends the provision of a displaceable portion of the cam means and means for urging the cam follower against the displaceable portion so as to cause movement of the cam follower from the first position to the second position as a result of further relative movement between the cam follower and cam in the event that the cam follower is not urged from the first position to the second position by the spring biasing means.

The displaceable portion of the cam may comprise an integral portion thereof. In the illustrated embodiment, the displaceable portion is connected to a first portion whereby the displaceable portion is movable in the manner of a gate to pass the cam follower.

The cam follower is normally urged through a first transfer space by the spring means, thus, in normal operation of the cam control mechanism, the displaceable portion of the cam remains inactive. The displaceable portion, however, when displaced, defines a second transfer space and thus provides an alternative means for conducting the cam follower from the first position to the second position.

In the illustrated embodiment, the cam surfaces comprise surfaces of arcuate wall portions and the cam follower is caused to move radially outwardly through the respective transfer spaces in moving from the first position to the second position. The cam comprises a rotatable cam which rotates relative to the cam follower which is biased radially in following the cam surfaces.

When the cam follower passes in its normal manner from the first position to the second position through the first transfer space, continued rotation of the cam and the biasing means associated with the cam follower cause the cam follower to ride over the outer surface of the displaceable portion, which under these conditions constitutes an effectively normal cam surface of the cam permitting normal continued relative movement between the cam and cam follower in carrying out the operation of the cam control mechanism.

The cam control mechanism of the present invention is relatively simple and economical of construction while yet providing the highly improved functioning discussed above. The structure is maintenance free and provides a high reliability in the critical cam control applications.

BRIEF DESCRIPTION OF THE DRAWINGS

Other features and advantages of the invention will be apparent from the following description, taken in connection with the accompanying drawing wherein.

BEST MODE FOR CARRYING OUT THE INVENTION

Figure 1:
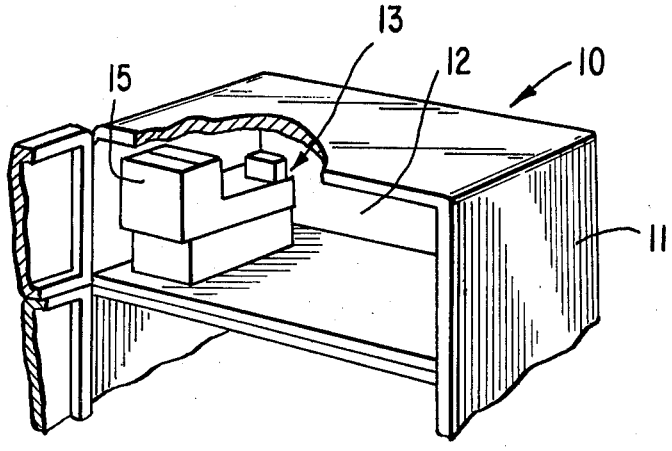
FIG. 1 is a fragmentary perspective view of a refrigeration apparatus having a cam control mechanism embodying the invention.

In the illustrative embodiment of the invention as disclosed in the drawing, a refrigeration apparatus generally designated 10, is shown to comprise a cabinet 11 defining a refrigerated space 12, in which is mounted an automatic ice maker 13. The ice maker includes a cam operated control mechanism, generally designated 14, mounted in a suitable housing portion 15. The use of the control mechanism 14 in connection with an ice maker is exemplary only, it being understood that the improved control mechanism may be utilized in a wide range of different industrial applications.

Figure 2:
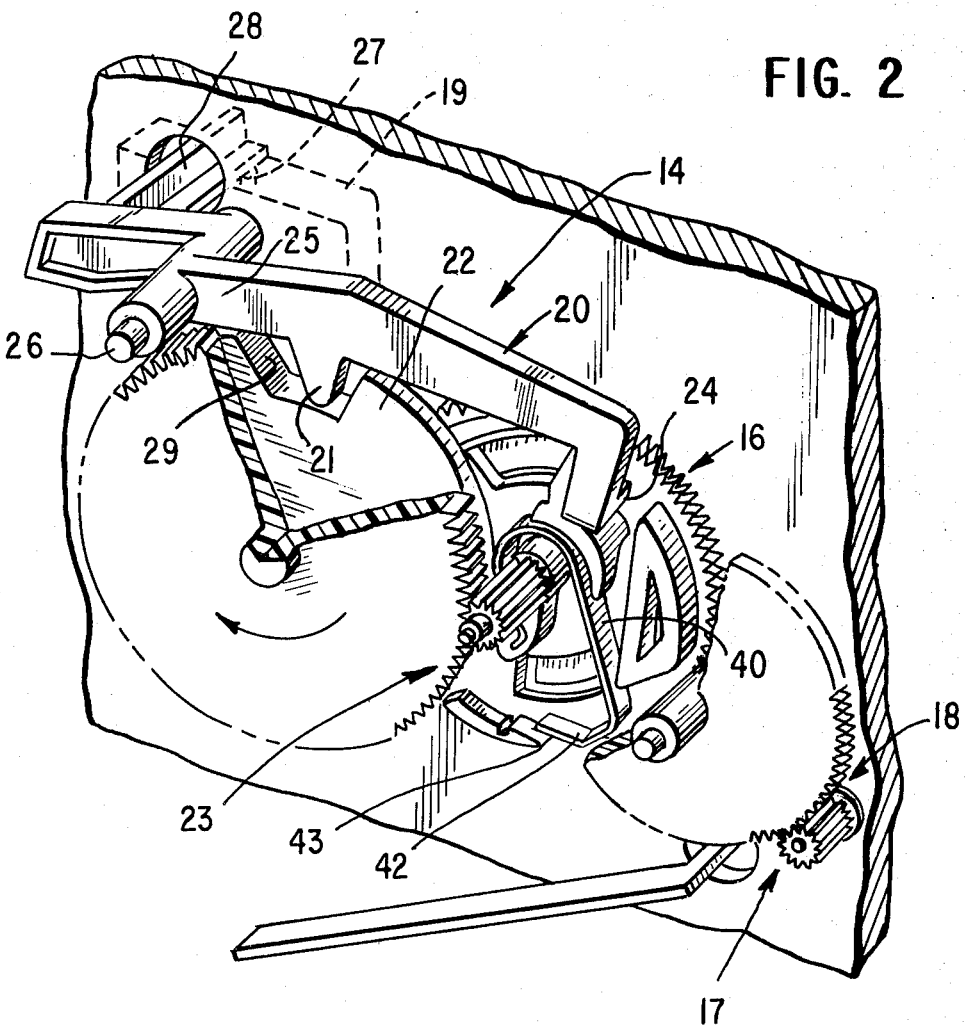
FIG. 2 is a fragmentary enlarged perspective view with portions broken away illustrating the cam control mechanism in greater detail.

The control mechanism 14, as more clearly illustrated in FIG. 2, is generally similar to the control mechanism of the above discussed Linstromberg U.S. Pat. No. 4,130,746, to which patent reference may be had for a more complete disclosure of the relationship of the control mechanism and the refrigeration apparatus components. Briefly, however, as shown in FIG. 2, the control mechanism includes a cam 16 which is rotatably driven by a timer motor drive 17, including a plurality of drive gears 18. The control includes a double throw switch 19 which may comprise a snap action switch.

A cam follower 20 includes a first control portion 21 engaging a second rotatably driven cam 22. Cam 22 is driven by suitable gearing 23 driven by the timer drive so as to provide control of the movement of cam follower 20 at preselected intervals corresponding to multiples of rotation of cam 16.

The distal end of cam follower 20 is defined by a turned finger portion 24. Cam follower 20 is pivotally mounted at a mid portion 25 thereof by a pivot 26.

Switch 19 includes a spring biased actuator 27 engaged by an end portion 28 of the cam follower 20 opposite distal end 24. The spring biased actuator 27 effectively defines spring means for urging the cam follower end portion 28 in a clockwise direction about the axis of pivot 26, thereby urging cam follower portion 21 against the peripheral surface of cam 22 and thus selectively into a recessed portion 29 thereof, as seen in FIG. 2, once during each revolution of cam 22.

Figure 3:
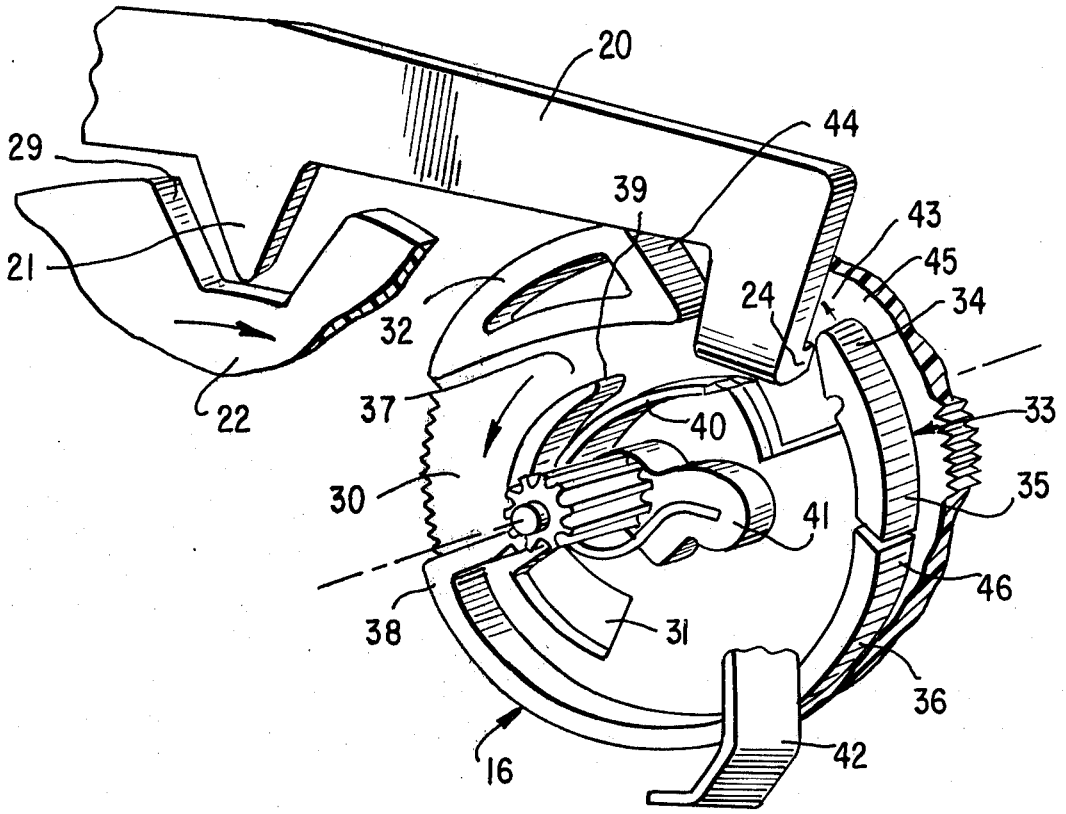
FIG. 3 is a further enlarged fragmentary perspective view illustrating the cam control mechanism in still further greater detail.

Referring now more specifically to the illustration of cam 16 in FIG. 3, the cm may be seen to comprise a disc 30 having a fixed, radially inner, arcuate wall 31, a first fixed, radially outer, arcuate wall 32, a second radially outer arcuate wall generally designated 33 having a fixed end portion 34 and a resiliently flexible end portion 35, and a third, fixed radially outer wall 36.

As shown in FIG. 3, cam follower end 24 extends toward disc portion 30 of the cam 16 and is urged by the spring actuator 27 radially inward when the cam follower portion 21 is received in the recess 29 of cam 22. Thus, follower end portion 24 will follow a cam path including a first, inner position 37 radially inward of fixed wall 32 when the cam rotates in the counterclockwise direction, as seen in FIG. 3, so as to cause movement of the cam follower end portion 24 off the trailing edge 38 of the fixed wall 36. The radially inward movement of the follower portion 24 is limited by abutment thereof with fixed inner wall 31 so as to guide the follower portion 24 in the inner arcuate path position 37 as seen in FIG. 3.

When the counterclockwise rotation of cam 16 continues to the point where the cam follower portion 24 passes beyond trailing edge portion 39 of the inner wall 31, radially outward biasing of the cam follower is effected by an arcuate spring 40 having one end secured to the cam by a connector 41. As shown in FIG. 2, spring 40 includes a distal end 42 which, as a result of the resiliency of the spring, extends through a first transfer space 43. Under normal operation, cam follower portion 24 is urged outwardly through the transfer space 43 by spring end 42 when the cam rotates sufficiently to cause follower portion 24 to pass beyond trailing edge 44 of the fixed wall 32. Thus, cam follower portion 24 is effectively transferred from the first, radially inner position 37 of the cam path to a second, radially outer position 45 thereof.

Continued clockwise rotation of the cam causes the relative movement between the cam and cam follower to result in a movement of the follower portion 24 along the peripherally outer surface of wall portions 33 and 36. It may be seen that this movement is normally permitted only when cam 22 is rotated to the position wherein the follower portion 21 may move into the recess 29 and that in all other rotational positions of cam 22 the follower portion 21 maintains the cam follower with end portion 24 thereof adjacent the outer surface of the wall portions 32, 33 and 36, so as to effectively maintain cam follower portion 24 in the second, or radially outer position thereof.

As shown in FIG. 3, displaceable wall portion 35 is disposed closely adjacent the leading end 46 of fixed wall portion 36 so as to effectively define therewith a substantially continuous outer peripheral guide for the cam follower portion 24 in moving from the transfer space 43 to the trailing edge 38 of fixed wall 36.

Figure 4:
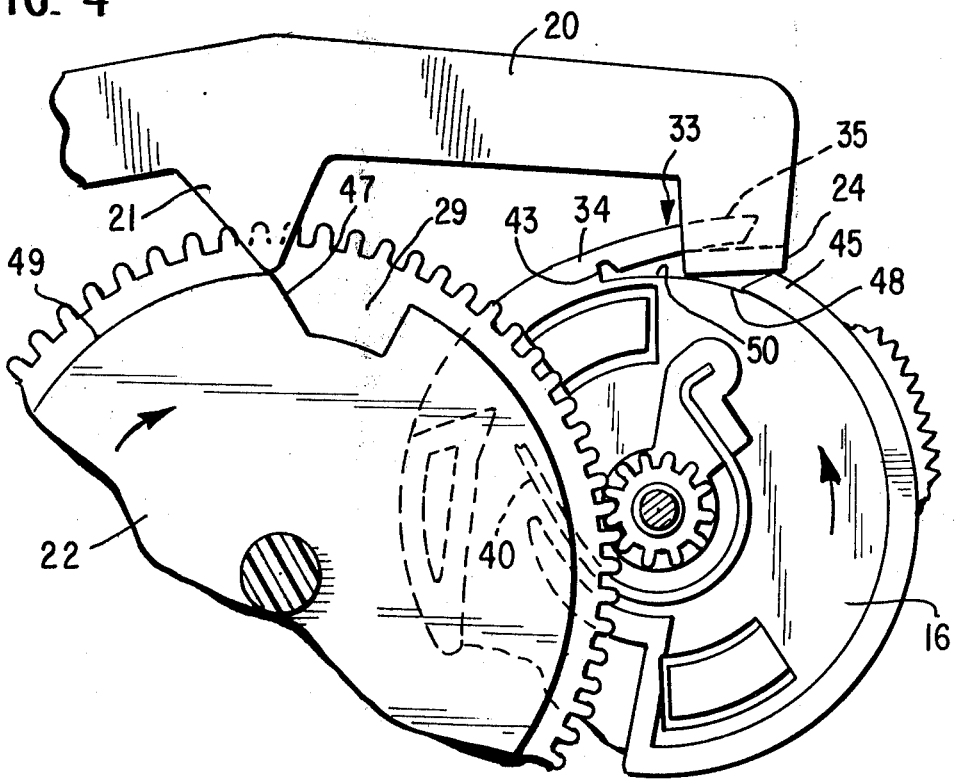
FIG. 4 is a fragmentary side elevation illustrating the movement of the cam follower through the second transfer space in the operation of the cam control mechanism.

In the illustration of FIG. 3, spring 40 is shown as broken so as to be unable to urge the cam follower portion 24 outwardly through transfer space 43. Under these conditions, control switch 19 is not actuated, thus causing undesirable maintenance of the ice maker control mechanism in the condition of FIG. 2. As indicated briefly above, the present invention comprehends an improved fail safe structure which is encompassed in the utilization of the displaceable cam portion 35. More specifically, as illustrated in FIG. 4, where the cam follower portion 24 is prevented from being urged outwardly through the first transfer space 43 as by breaking of the spring 40, cam follower portion 24 passes under the fixed end 34 of cam wall 33 until the cam follower portion 21 is moved radially outwardly by its engagement with inclined trailing surface 47 of recess 29 of cam 22. The outward urging of the cam follower portion 21 causes cam follower end 24 to urge displaceable wall portion 35 radially outward as seen in FIG. 4, so as to permit cam follower portion 24 to pass radially outward through a then formed second transfer space 48, comprising the space from which the displaceable portion 35 is moved by cam follower portion 24. Continued counterclockwise rotation of cam 16 now permits cam follower portion 24 to ride along the outer surface of fixed wall 36 back to the trailing edge 38 thereof, with the cam follower portion 24 being maintained in the radially outer position 45 by the cam follower portion 21 riding on the outer surface 49 of the cam 22 as illustrated in FIG. 4.

In pivoting cam follower 20 to the position of FIG. 4, the force of cam surface 47 against cam follower portion 21 is sufficient to overcome the spring biasing action of spring actuator 27 of switch 19 and the radially inward biasing of cam follower portion 24 by displaceable wall portion 35. Thus, in the illustrated embodiment, in the event that spring 40 for some reason is ineffective to overcome this biasing action, positive force is developed by cam surface 47 against cam follower portion 21 to effect the transfer of cam follower portion 24 from the first inner position to the second outer position as discussed above.

In the illustrated embodiment, the cam 16 is formed of acetal resin and the displaceable portion 35 is formed integrally with the cam 16 is a molded portion thereof. To provided the desired displaceability the cam is provided with a slot 50, as shown in FIG. 4, extending circumferentially from the fixed portion 34 of the wall 33. As will be obvious to those skilled in the art, the displaceable portion may comprise a separate element movably mounted to the cam if so desired within the scope of the invention. When formed integrally with the cam 16, displaceable portion 35 should be flexible and, preferably, it should also be resilient.

INDUSTRIAL APPLICABILITY

As indicated above, the improved cam mechanism 14 may be utilized in a wide range of industrial applications. The advantageous use thereof in controlling the apparatus control switch 19 of an ice maker is exemplary. As further indicated above, the novel structural concepts of cam mechanism 14 may be utilized not only in the fail safe operation discussed above, but also where it is desired to provide selective transfer of a cam follower from a first position to a second position as by intentional utilization of the second transfer space defined by the displaceable portion of the cam.

Thus, the invention broadly comprehends the use of a displaceable cam portion to effect transfer between a plurality of cam follower positions.

The improved cam operated control mechanism 14 is extremely simple of construction, while yet providing the improved functioning discussed above. The mechanism is advantageously adapted for use in a wide range of control mechanism where repeated reliable operation is important.

The foregoing disclosure of specific embodiments is illustrative of the broad inventive concepts comprehended by the invention.

Having described the invention, the embodiments of the invention in which an exclusive property or privilege is claimed are defined as follows:

1. In a cam operated control mechanism having a control cam, a cam follower, and means for biasing said cam follower into engagement with said control cam, the improvement comprising:

means defining a first cam surface on said control cam for engaging a portion of said cam follower;

means defining a second cam surface on said control cam and being spaced from said first cam surface for effecting movement of said cam follower as it sequentially engages said first and second cam surfaces;

a movable gate member formed within one of said first and second cam surfaces to permit movement of said cam follower through said one of said surfaces; and means for urging said cam follower against said movable gate member to move said follower from engagement with one said cam surface into engagement with the other cam surface.

2. The cam operated control mechanism of claim 1 wherein said control cam comprises a rotating cam and said first surface is disposed radially outward of said second surface.

3. The cam operated control mechanism of claim 2 wherein said movable gate member defines a portion of said first cam surface and is deflectable radially outward to permit said follower to move from said second surface outward through said first cam surface and subsequently into engagement with said first cam surface.

4. The cam operated control mechanism of claim 1 wherein said movable gate member is formed integrally with the means defining one of said cam surfaces.

5. In a cam operated control mechanism having a control cam, a cam follower, and means for biasing said cam follower into engagement with said control cam, the improvement comprising:

means defining a first cam surface on said control cam for engaging a portion of said cam follower, means defining a second cam surface on said control cam and being spaced from said first cam surface for effecting movement of said cam follower as it sequentially engages said first and second cam surfaces;

a movable gate member formed within one of said first and second cam surfaces to permit movement of said cam follower therethrough; and means for urging said cam follower against said movable gate member to move said follower through said first cam surface only as an incident of a failure of the cam operated control mechanism.

6. An improved cam control mechanism comprising:

a cam defined by a first wall portion having an end, a second wall portion having a first end spaced from said first wall portion end to define a first transfer space therebetween, said second wall portion having a resiliently displaceable portion defining a normally closed second transfer space extending through said second wall portion;

a cam follower;

first biasing means for biasing said cam follower against said first wall portion;

means for effecting relative movement between said cam follower and cam to cause said cam follower to become aligned with said first transfer space and be urged therethrough by said first biasing means;

and second biasing means for biasing said cam follower against said second wall portion as a result of continuation of the relative movement between said cam follower and cam in the event said first biasing means fails to urge the cam follower through said first transfer space, said second biasing means causing said cam follower to displace said displaceable wall portion and move through said second transfer space.

7. The cam control mechanism of claim 6 wherein said displaceable wall portion is formed integrally with said cam.

8. The cam control mechanism of claim 7 wherein said wall portions are arcuate.

9. The cam control mechanism of claim 7 wherein said second wall portion includes a fixed portion adjacent said first transfer space.

10. The cam control mechanism of claim 9 wherein said displaceable portion is resiliently connected to said fixed portion.

11. The cam control mechanism of claim 6 wherein said cam follower urges said displaceable portion to close said second transfer space as a result of the continued relative movement between said cam follower and cam after the cam follower moves through said first transfer space.

12. In an ice maker mechanism including a control switch, a spring biased actuator for moving said switch from a second to a first switched position, an improved cam controlled mechanism comprising:

a timer driver means;

cam means arranged to be driven by said timer drive means; and a cam follower, said cam follower having a first portion operatively engaging said actuator and a second portion engaging said cam means, said cam means having first and second cam surfaces sequentially engaging said second follower portion as an incident of the driving of said cam means by said timer drive means for selectively positioning said second follower portion in first and second positions to thereby correspondingly effect positioning of said switch selectively in said first and second switched positions, said cam means further including first moving means for rapidly moving said second follower portion from said first position to said second position, and second moving means for moving said second follower portion from said first position to said second position in the event said first moving means does not move said second follower portion to said second position.

13. The ice maker mechanism of claim 12 wherein said cam means is arcuate and said first cam surface is formed integrally with said cam means.

14. The ice maker mechanism of claim 13 wherein said switch comprises a snap action switch.

15. The ice maker mechanism of claim 12 wherein said cam means includes a resiliently displaceable portion arranged to be displaced by said cam follower when said second moving means acts to move said cam follower from said first position to said second position.

16. An improved rotary cam comprising:

means defining a first cam surface;

means defining a second cam surface spaced radially from said first cam surface; and a movable gate member carried by one of said first and second cam surfaces, said gate member defining a substantially continuous portion of said one cam surface and being selectively movable so as to define a generally radially opening through said one cam surface to permit a cam follower to selectively follow said one cam surface or follow the other cam surface up to said gate member and then be moved through said opening to commence following said one cam surface.

17. The rotary cam of claim 16 wherein said movable gate member is formed of a flexible material.

18. The rotary cam of claim 16 wherein said movable gate member is formed integrally with said one cam surface.

19. The rotary cam of claim 18 wherein said movable gate member comprises a resilient, flexible extension of said one cam surface.

* * * * *